US006109190A

United States Patent [19]

Hale et al.

[11] Patent Number: 6,109,190

[45] Date of Patent: Aug. 29, 2000

[54] MATERIALS HANDLING PALLET

[75] Inventors: Ronald G. Hale, Mesquite, Tex.; Paul A. Kruger, Norman, Okla.; David A. Byers, Balch Springs, Tex.

[73] Assignee: Plastic Pallet Production, Inc., Dallas, Tex.

[21] Appl. No.: 09/421,766

[22] Filed: Oct. 19, 1999

[51] Int. Cl.[7] ..... B65D 19/38

[52] U.S. Cl. ..... 108/57.25; 108/57.26

[58] Field of Search ..... 108/57.25, 57.26, 108/901, 902, 51.11, 56.1, 56.3

[56] References Cited

U.S. PATENT DOCUMENTS

| | | | |
|---|---|---|---|
| 3,757,704 | 9/1973 | Allgeyer et al. | 108/57.26 |
| 4,597,338 | 7/1986 | Kreeger | 108/57.26 |
| 5,497,709 | 3/1996 | Gonzalez et al. | 108/902 X |
| 5,579,686 | 12/1996 | Pigott et al. | 108/902 X |
| 5,887,529 | 3/1999 | John et al. | 108/57.26 X |
| 6,006,677 | 12/1999 | Apps et al. | 108/57.25 |
| 6,029,583 | 2/2000 | LeTrudet | 108/57.25 |

*Primary Examiner*—Jose V. Chen

*Attorney, Agent, or Firm*—Crutsinger & Booth; James O. Dixon

[57] ABSTRACT

A molded plastic product and material handling pallet comprising upper and lower pieces of different plastic materials assembled in separable mating registration to provide a pervious product bed and a lower framework of sufficient strength for vertical stacking storage of product-loaded pallets in open racks.

14 Claims, 2 Drawing Sheets

MATERIALS HANDLING PALLET

TECHNICAL FIELD

The present invention relates to pallets used for the handling, shipping, storing and moving of materials, parts, packages, products, etc. in warehouses, factories and vehicles.

BACKGROUND OF INVENTION

It has long been the practice of manufacturers and shippers and warehousers to use platforms of standardized size and usually of wood for the efficient stocking, storage, handling, moving and shipping of a large variety of products, goods and materials. These platforms called pallets are in the form of a framework providing a deck on which the products or goods may be placed often in stacked relationship as a unitary "packet" for handling. The packet may or may not be affixed to the deck of the pallet. The rest of the framework of the pallet comprises support and brace members attached to the deck that not only provide strength for the platform but create access spaces under the deck so that material handling equipment such as forklifts may be used in handling the packaged goods.

Storing and warehousing of palletized goods is more efficient when large shelves are used for the vertical stacking storage of the goods.

Because of its strength and ruggedness, light weight and simplicity of construction methods, wood is the material most often used presently for goods pallets. However, the useful of life of wood pallets is usually only about five to eight shipments, i.e., transfers of goods over significant distances. In spite of its strength and ruggedness, the wood of the pallets tends to split, splinter or break over such a period under the rough handling to which the pallets are ordinarily subjected. Fasteners such as nails, screws or brads that may be exposed by breaking and cracking can cause product damage.

Often, also wooden pallet life is shortened when goods packages rupture spilling products and materials that tend to weaken, deform or discolor the wood or to produce noxious odors and bacteria and mold growth.

SUMMARY OF INVENTION

The present invention provides a two-piece plastic snap-together pallet for handling goods. The lower or framework portion of the pallet is made of a material strong enough to allow open edge rack storage of loaded pallets. The upper portion which is the deck or goods platform of the pallet is made of a lower strength and less expensive material. Since the pallet parts are separable, a broken deck or platform portion can be replaced at lower cost than replacing an entire pallet. The materials of the upper and lower portions of the pallet are fully recyclable separately. The average life of the plastic pallet of the present invention is increased to more than about ten times that of previously used wooden pallets because of the greater strength and resistance to chemical attack.

Further, storage facilities for the product-loaded pallets of the present invention may be of the open rack drive-through type and thus much less expensive and more accessible than the shelving most often used presently.

BRIEF DESCRIPTION OF THE DRAWINGS

Annexed hereto for better and fuller understanding of the invention as set forth in the following detailed description are drawings of the preferred embodiment of the invention, in which.

The same numeral references are employed to designate like parts throughout the various figures of the drawing.

DETAILED DESCRIPTION OF THE INVENTION

Figures 1, 2:
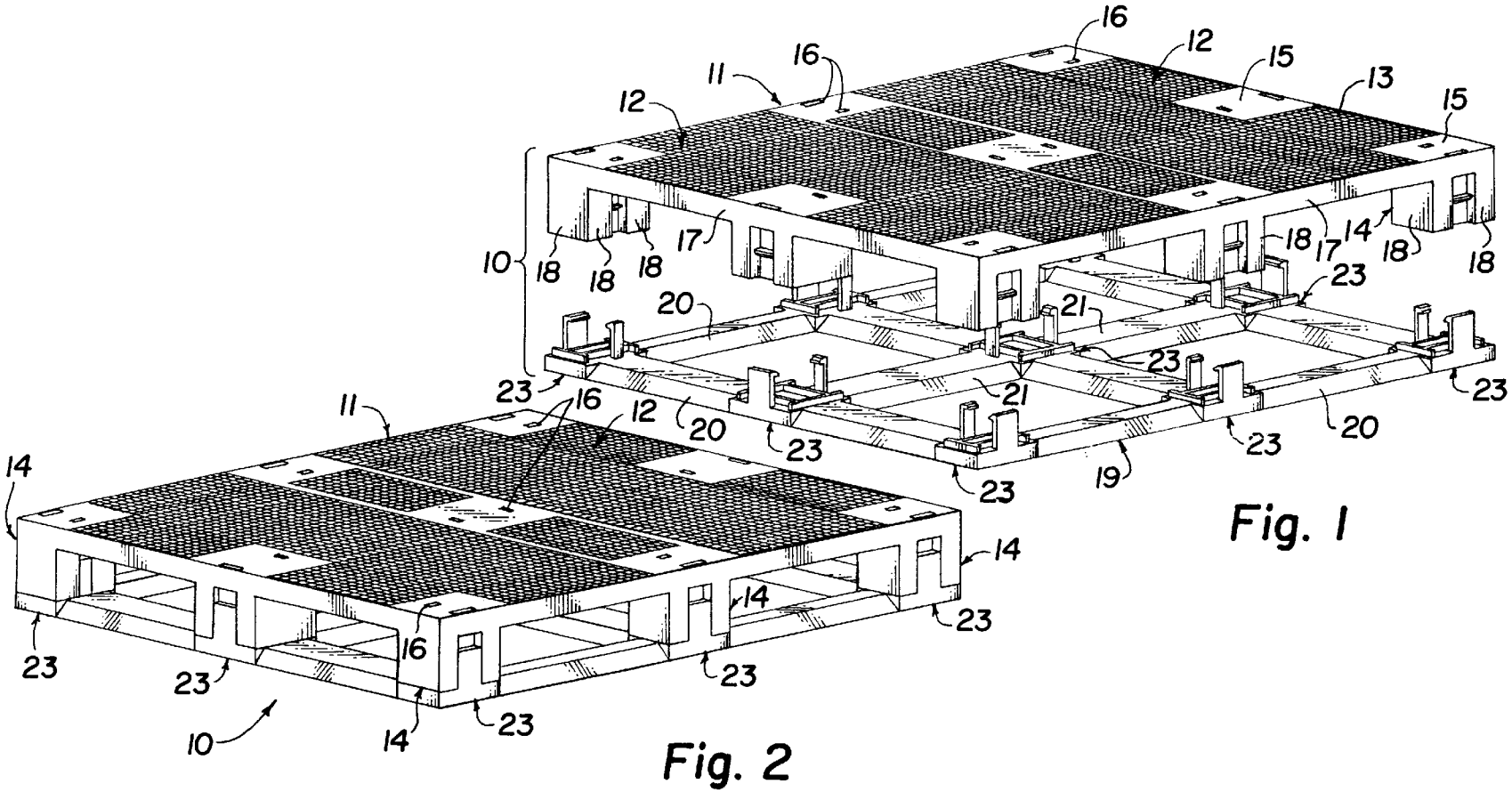
FIG. 1 is a perspective view from slightly above one comer of the two pallet pieces just prior to mating assembly into a complete pallet.
FIG. 2 is a perspective view from slightly above one corner showing the pallet of the present invention filly assembled.

Referring now to FIGS. 1 and 2 of the drawings, there is shown the pallet of the present invention designated generally as 10.

The upper pallet piece 11 forms the bed deck or product or platform area of the pallet 10. The entire upper piece 11 is of molded plastic preferably of high density polyethylene or other material. The upper piece 11 is of one-piece construction comprising the pervious main bed or deck slab 12 of cellular honeycomb-like construction for light weight strength. The openings 13 also allow material spillage of product or materials to pass through the bed and not accumulate on the bed. Although the openings 13 are shown in the drawing to be generally rectangular or square, they may be of any suitable shape, octagonal or hexagonal, for example.

Hollow locking upper member support posts 14 are provided in appropriate positions to provide needed support strength. Posts 14, as shown in FIGS. 1 and 2, are provided at the corners of the upper piece 11 midway along each side and in the middle of the bed. The top surface 15 of each slab 14 is a solid surface except for a pair of openings 16 arranged to facilitate separation of the pallet pieces as will be explained later.

The peripheral sides 17 of the pallet bed slab 12 are solid or unbroken surfaces as are the downwardly extending outer surfaces 18 of the support posts 14.

A standard size for the pallet may be about 40×48 inches. The bed 12 of the pallet may be from about 1¼ to 1½ inches thick depending on the strength of the plastic used for it. The upper member support posts 14 extend from about 3½ to about 3¾ inches below the bottom of the bed 12.

Figure 3:
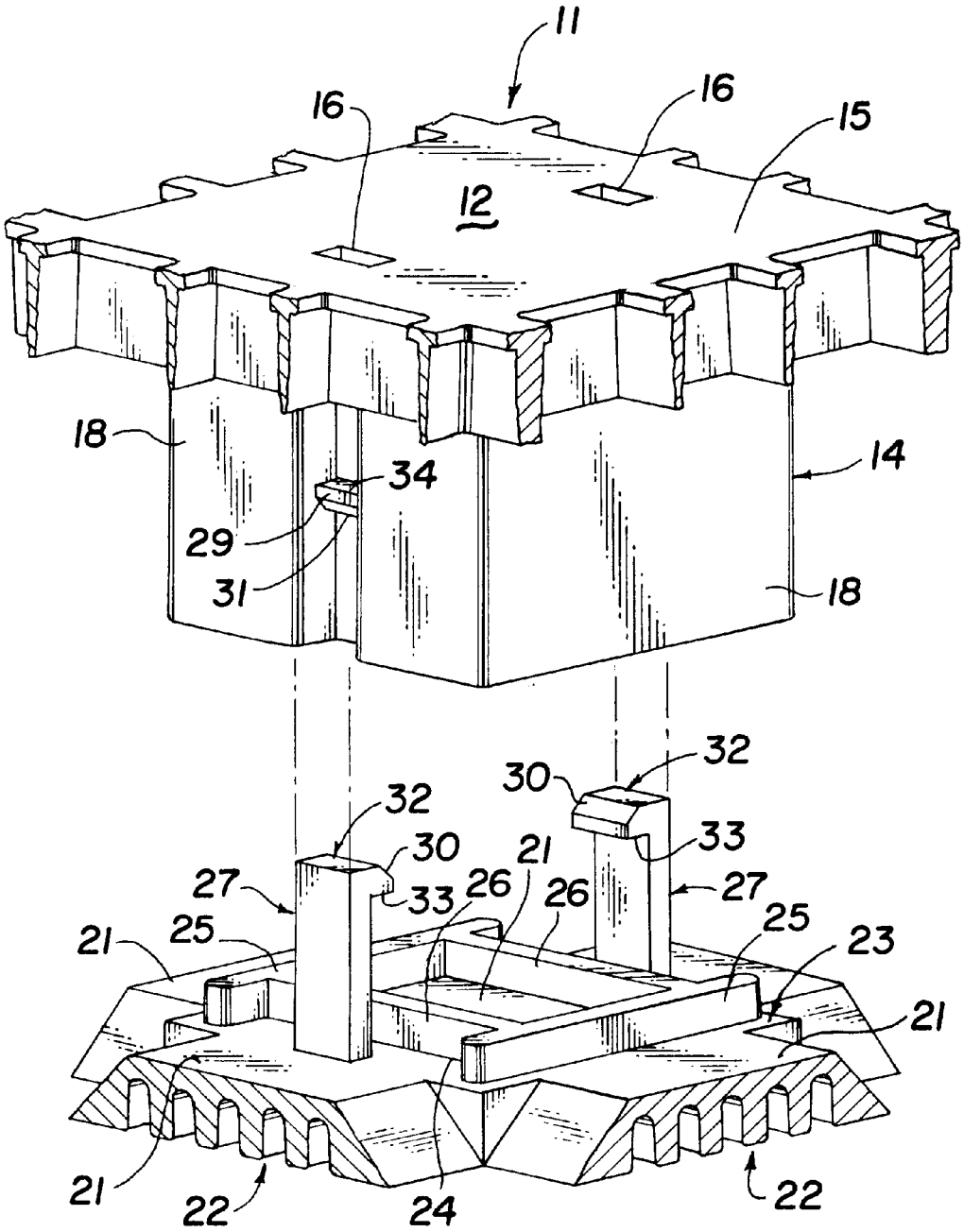
FIG. 3 is a perspective view partly in section from slightly above a corner of the latching support post structure locking the two pallet pieces together.

The bottom or lower piece 19 is of molded high strength plastic and may be in the form of a framework having four side rail members 20 and two cross-rail brace members 21. A special grade polypropylene plastic of a tensile modulus of between 600,000 and 800,000 psi has been found to be a suitable material from which to make the lower piece 19. Bottom piece 19 is of essentially the same width and length as upper piece 11. The side and cross-rail members 20 and 21 may be of a ribbed construction as indicated at 22 in FIG. 3 showing cross-sections of rails 21. A plurality of support platforms or pad areas 23 are provided on lower piece 19 at its corners, in the middle and at the mid-points on each side rail 20. Each of the pads 23 are arranged for mating engagement with a support post 14.

As best shown in FIG. 3, pad areas 23 have a base surface 24 coplanar with the upper surfaces of rails 20 and 21. Upstanding from the top of each pad are guide members 25 and connecting cross-guide members 26. Guide members 25 and cross-guide members 26 are positioned and sized to properly position support posts 14 when the upper and lower pieces 11 and 19 of the pallet 10 are mated. The outer vertical surfaces of guide 25 and 26 fit against the vertical inner walls within the hollow support posts 14.

Also, upstanding from the base surface 24 of each support post pad 23 are two latching fingers 27. Fingers 27 are located opposite each other outward from cross-guide 26 and between guides 25. Fingers 27 are of appropriate size to provide required strength but thin enough to allow flexing in and out as will be explained subsequently.

Support posts 14 are provided with a pair of groove-like recesses 28 located on opposing walls of the parts. Provided within each recess is an appropriately placed projecting ridge or ledge 29 for locking attachment by fingers 27 to hold upper and lower pieces 11 and 19 together when brought into mating contact to form the finished pallet.

When the upper and lower pieces 11 and 19 are urged together for mating assembly, fingers 27 slide along grooves 28 until the upper beveled edge 30 of projecting shoulder 32 of finger 27 contacts the lower beveled edge 31 of ledge 29 flexing fingers 27 out to slide past the ledges 29. As the upper and lower pieces 11 and 19 come together, the lower edge 33 of shoulder 32 passes the upper edge 34 of ledge 29 allowing fingers 27 to snap back into their normal positions latching the two pieces of the pallet together. Should either of the two pallet pieces (usually the upper piece 11) become damages or broken, it can be replaced by separating the two pieces and replacing the damaged piece with a new piece and attaching it to the undamaged piece, thus saving the cost of a totally new pallet. The two pallet pieces may be separated by insertion of a blade-shaped tool into the opening 16 of the upper piece to bear against beveled surfaces 30 of fingers 27 to flex the upper portions of fingers 27 outward and release the latch.

By using the stronger (even though possibly more expensive) material for the lower piece 19, the loaded pallets of the present invention can be used to store goods in rack structures rather than in shelving. Rack structures, as referred to herein are framework structures wherein the loaded pallets are supported by rail-like members running under each of the pallet side rails. Because the lower pieces of the pallets of the present invention are strong enough to bear the fill weight of the loaded pallet, there is no need for the loaded pallets to be supported on shelves when stored.

Thus, there has been described a new light-weight product handling pallet comprising latched together upper and lower pieces of different plastic materials. The pallet is strong enough to sustain its loaded weight only by its side rails. Many changes and variations still within the scope and spirit of this disclosure will occur to those others from the above description, thus this invention is to be limited only a set forth in the following claims.

What is claimed is:

1. A product and material handling pallet comprising:

a molded plastic upper piece and a molded plastic lower piece, said upper and lower pieces adapted for latched mating when brought together in registration;

said upper piece comprising a pervious load bed predominantly of cellular honeycomb-like construction and a plurality of support posts having side walls extending downwardly from said load bed, each of said support posts being at least partially hollow and open at its lower end, each of said support posts having a recessed slot in at least one of said side walls extending from the lower end of said support post toward said load bed, and a latch ledge projection within said slot and located at a distance from the lower end of said slot;

said lower piece comprising a framework of interconnected side rail members, cross-rail brace members and a plurality of support post platforms, each said platform having a base surface and at least one upstanding latch finger extending upwardly from said base surface and terminating at its upper end in a projecting latch shoulder;

said support post platforms being so arranged and positioned as to each mate in registration with one of said support posts with said at least one latch finger extending into a recessed slot of said support post sufficiently that said shoulder of said latch finger latches over said latch ledge of said slot.

2. The pallet as defined in claim 1 further comprising a plurality of guide members positioned on said platform base surfaces to extend into said support posts when said support posts are brought into registration with said base surfaces and said upper and lower pieces are mated thereby to steady and brace said support posts.

3. A The pallet as defined in claim 2 wherein said latch fingers are flexible in a direction allowing movement of said latch shoulders past said latch ridges to achieve latching engagement when said upper and lower pieces are mated in registration.

4. The pallet as defined in claim 3 wherein said support posts are so constructed as to provide access to said latch fingers when said upper and lower pieces are mated in registration whereby said latching engagement may be released.

5. The pallet as defined in claim 3 wherein said upper and lower pieces are made of different plastic materials.

6. The pallet as defined in claim 1 wherein said latch fingers are flexible in a direction allowing movement of said latch shoulders past said latch ridges to achieve latching engagement when said upper and lower pieces are mated in registration.

7. The pallet as defined in claim 6 wherein said support posts are so constructed as to provide access to said latch fingers when said upper and lower pieces are mated in registration whereby said latching engagement may be released.

8. The pallet as defined in claim 6 wherein said upper and lower pieces are made of different plastic materials.

9. The pallet as defined in claim 1 wherein said plurality of support posts are positioned at each corner, at the midpoint of each side and in the middle of said upper piece.

10. The pallet as defined in claim 1 wherein said upper and lower pieces are made of different plastic materials.

11. A product and material handling pallet comprising:

a molded plastic upper piece and a molded plastic lower piece adapted for latched mating when said upper and said lower pieces are brought together in registration;

said upper piece comprising a pervious load bed predominantly of cellular honeycomb-like construction and a plurality of support posts having side walls extending downwardly from said load bed, each of said support posts being at least partially hollow and open at its lower end, each said support post having a recessed slot in at least one of said side walls extending from the lower end of said support post toward said load bed, and a latch ledge projection within said slot and located at a distance from the lower end of said slot;

said lower piece comprising a framework of interconnected side rail members, cross-rail brace members and a plurality of support post platforms, each said platform having a base surface and at least one upstanding latch finger extending upwardly from said base surface and terminating at its upper end in a projecting latch shoulder;

said support post platforms being so arranged and positioned as to each mate in registration with one of said support posts with said at least one latch finger extending into a recessed slot of said support post sufficiently that said shoulder of said latch finger latches over said latch ledge of said slot;

each of said latch fingers being flexible in a direction allowing movement of said latch shoulder of said finger past said latch ridge to achieve latching engagement;

and guide members on each said platform base surface positioned to extend within and steady and brace said support post when said post is brought into registration with said base surface.

12. The pallet as defined in claim 11 wherein said upper and lower pieces are made of different plastic materials.

13. The pallet as defined in claim 12 wherein said support posts are so constructed as to provide access to said latch fingers w en said upper and lower pieces are mated in registration whereby said latching engagement may be released.

14. The pallet as defined in claim 13 wherein said plurality of support posts are positioned at each corner, at the midpoint of each side and in the middle of said upper piece.

* * * * *